US006279480B1

(12) United States Patent
Roosmann

(10) Patent No.: US 6,279,480 B1
(45) Date of Patent: Aug. 28, 2001

(54) FIRING PIN ASSEMBLY FOR A WARHEAD DETONATOR

(75) Inventor: Karlheinz Roosmann, Ratingen (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/422,072

(22) Filed: Oct. 21, 1999

(30) Foreign Application Priority Data

Oct. 21, 1998 (DE) ..... 198 48 356

(51) Int. Cl.[7] ..... F42B 12/02

(52) U.S. Cl. ..... 102/272; 102/272; 102/274; 102/236; 102/488; 102/252

(58) Field of Search ..... 102/236, 247, 102/253, 252, 259, 256, 488, 272, 274

(56) References Cited

U.S. PATENT DOCUMENTS

| | | | | |
|---|---|---|---|---|
| 1,382,750 | * | 6/1921 | Sparague et al. | 102/499 |
| 1,509,329 | * | 9/1924 | Woodberry | 102/272 |
| 1,514,743 | * | 11/1924 | Taylor | 102/392 |
| 1,541,279 | * | 6/1925 | Remondy | 102/272 |
| 1,618,944 | * | 2/1927 | Pantoflicek | 102/239 |
| 3,439,615 | * | 4/1969 | Forman et al. | 102/485 |
| 3,730,004 | * | 5/1973 | Cwycyshyn et al. | 102/253 |
| 4,160,414 | * | 7/1979 | Stockman et al. | 102/483 |
| 4,619,200 | | 10/1986 | Bell . | |
| 4,690,057 | * | 9/1987 | Carlsson | 102/266 |
| 4,969,397 | * | 11/1990 | Gunther et al. | 102/233 |

FOREIGN PATENT DOCUMENTS

| | | |
|---|---|---|
| 0 229 302 | 7/1987 | (EP) . |
| 614056 | 12/1926 | (FR) . |

* cited by examiner

*Primary Examiner*—Charles T. Jordan
*Assistant Examiner*—Lulit Semunegus
(74) *Attorney, Agent, or Firm*—Venable; Gabor J. Kelemen

(57) ABSTRACT

A firing pin assembly for mechanically igniting a warhead detonator of a projectile by being accelerated in a forward direction by inertia upon impact, includes a firing pin having a rearward firing pin part and a frontal firing pin part arranged in series with the rearward firing pin part as viewed in the forward direction. The assembly further has a firing pin spring urging the firing pin in a direction opposite to the forward direction, and a mechanical device positioned between the rearward firing pin part and the frontal firing pin part. The mechanical device includes a transmission arrangement for transmitting a forward motion of the rearward firing pin part to the frontal firing pin part with a stepped up transmission ratio whereby a forward motion of the rearward firing pin part through a first distance results in a forward motion of the frontal firing pin part, against the force of the firing pin spring, through a second distance which is greater than the first distance.

9 Claims, 2 Drawing Sheets

FIG.2a
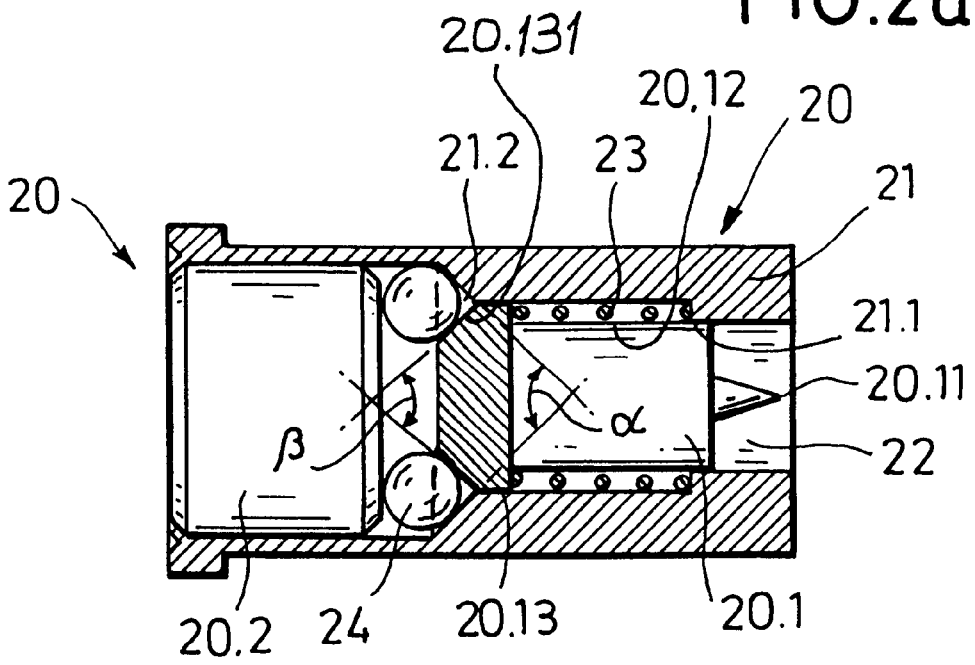
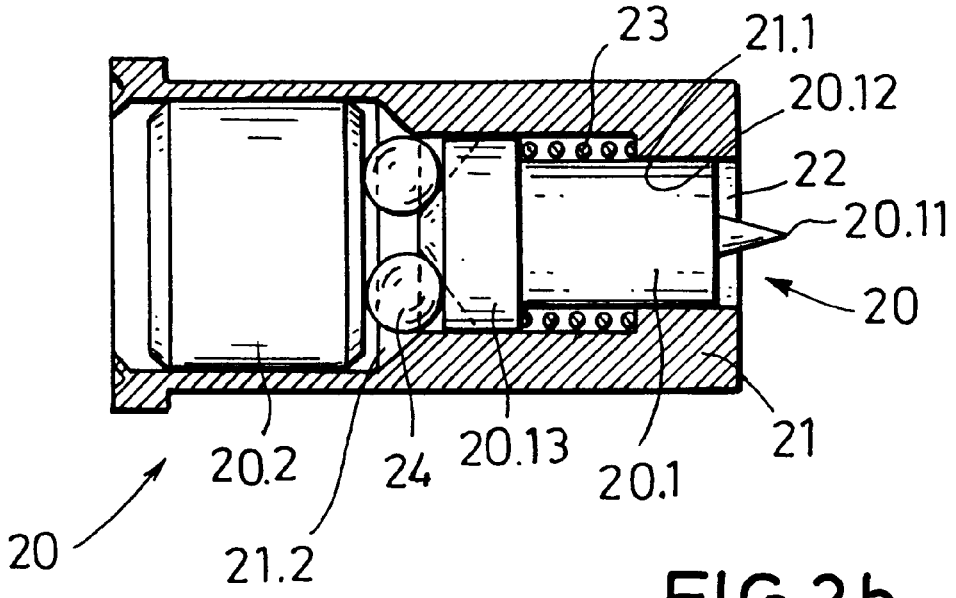
FIG.2b

FIRING PIN ASSEMBLY FOR A WARHEAD DETONATOR

CROSS REFERENCE TO RELATED APPLICATION

This application claims the priority of German Application No. 198 48 356.2 filed Oct. 21, 1998, which is incorporated herein by reference.

BACKGROUND OF THE INVENTION

This invention relates to a firing pin for mechanically igniting a warhead detonator situated in the bottom region of the projectile carrying the warhead. The firing pin is mechanically guided in a firing pin housing.

The purpose of detonators is to ignite (detonate) the explosive of the warhead of a projectile or an explosive charge at the target or at a desired moment. Detonators of the mechanical type are provided with a firing pin to initiate the detonation.

A firing pin of the above-outlined type is disclosed in German Offenlegungsschrift (application published without examination) No. 38 35 888. The firing pin is integrated in a mechanical bottom detonator. As the projectile hits the target, the firing pin is, by inertia, accelerated forward against the force of a firing pin spring into a detonator charge causing ignition thereof to thus ignite a hollow charge of the projectile. It is a disadvantage of such a prior art arrangement that the mechanical bottom detonator may be used only in projectiles of low impact speed and thus short range because the response time of the firing pin after impact of the projectile is excessively long for igniting the hollow charge. Therefore, a mechanical detonator cannot be used as a bottom detonator for hollow charge projectiles and thus for projectiles of greater muzzle and traveling velocity. Therefore, an electric bottom detonator has been conventionally used to ensure a very short response time in high-performance projectiles. Such an electric bottom detonator, however, is more complex and more expensive than mechanical bottom detonators.

SUMMARY OF THE INVENTION

It is an object of the invention to provide an improved mechanical detonator which may be used in projectiles of high impact velocity requiring short response times.

This object and others to become apparent as the specification progresses, are accomplished by the invention, according to which, briefly stated, the firing pin assembly for mechanically igniting a warhead detonator of a projectile by being accelerated in a forward direction by inertia upon impact, includes a firing pin having a rearward firing pin part and a frontal firing pin part arranged in series with the rearward firing pin part as viewed in the forward direction. The assembly further has a firing pin spring urging the firing pin in a direction opposite the forward direction, and a mechanical device positioned between the rearward firing pin part and the frontal firing pin part. The mechanical device includes a transmission arrangement for transmitting a forward motion of the rearward firing pin part to the frontal firing pin part with a stepped-up transmission ratio whereby a forward motion of the rearward firing pin part through a first distance results in a forward motion of the frontal firing pin part, against the force of the firing pin spring, through a second distance which is greater than the first distance.

The invention is based on the principle to significantly reduce the response time between impact and detonation by dividing the firing pin of the mechanical detonator into several parts and placing a step-up mechanism between the divided parts. As a result, even at higher speed, the time lapse from the moment of impact of the projectile to the moment of detonation is sufficiently short. The divided firing pin preferably is composed of two parts which are spaced from, and mechanically coupled to, one another preferably by three balls.

BRIEF DESCRIPTION OF THE DRAWINGS

FIG. 2*a* is an enlarged axial sectional view of the firing pin assembly shown in FIG. 1, illustrated in the safety position.

FIG. 2*b* is a view similar to FIG. 2*a*, showing the firing pin assembly in a detonating position.

DESCRIPTION OF THE PREFERRED EMBODIMENT

Figure 1:
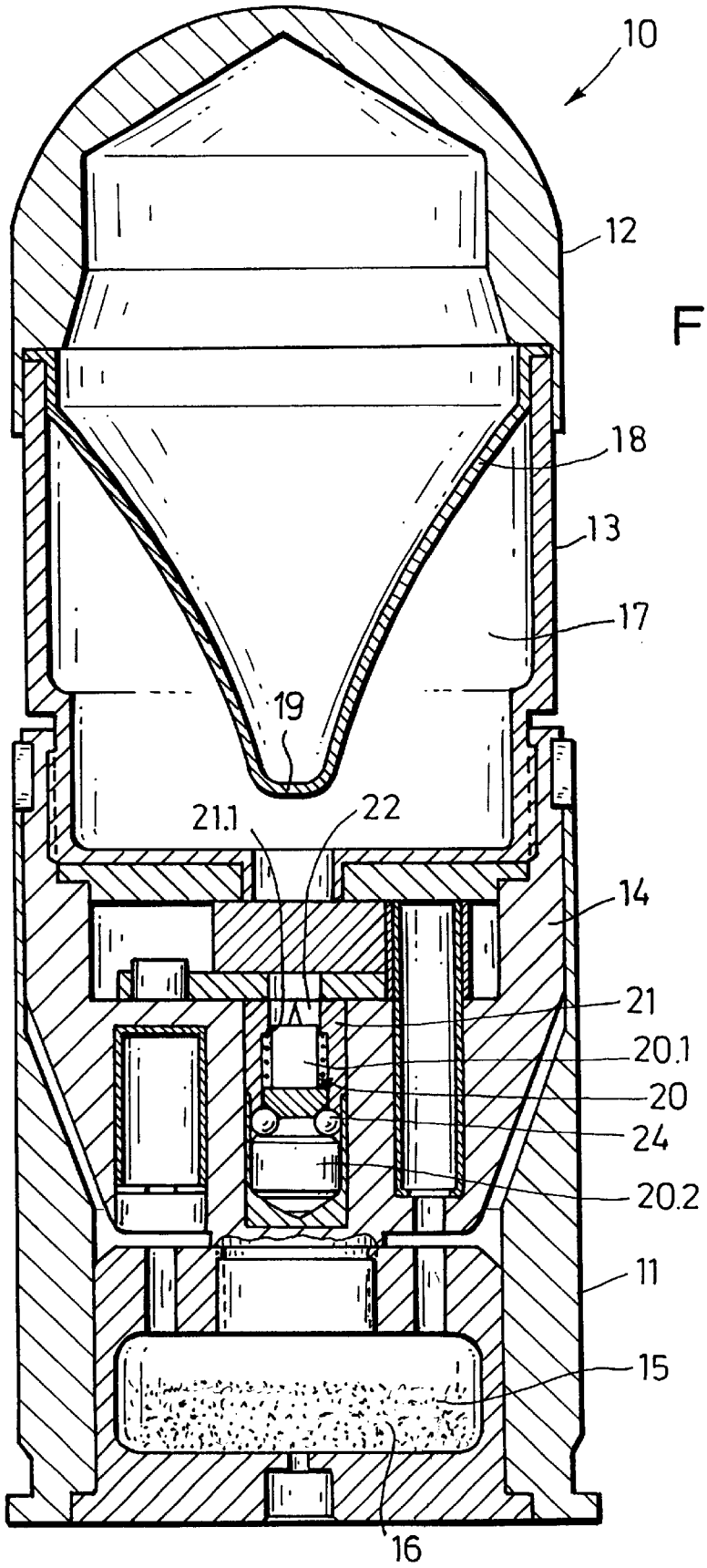
FIG. 1 is an axial sectional view of a grenade projectile showing a warhead and a firing pin assembly structured according to the invention.

FIG. 1 shows a grenade projectile 10 whose rear portion is secured in a propellant case 11. The grenade projectile 10 which may have a caliber of, for example, 40 mm, is a three-part structure, composed of a particularly structured frontal stand-off cap 12, a mid part formed of a projectile sleeve 13 and a rearward detonator housing 14 which accommodates the firing pin 20 structured according to the invention.

The propellant case 11 defines a central bottom cavity 15 which receives a propellant charge 16 for accelerating the grenade projectile 10.

The frontal part of the projectile comprises the warhead which, in addition to the pre-fragmented projectile sleeve 13, includes an explosive charge 17, a hollow charge 18 and the frontal cap 12. The hollow charge 18 is preferably of trumpet shape for increasing its effectiveness in the target area, that is, in the region of its central cone tip 19, the opening angle of the hollow charge 18 is the smallest and it gradually increases forwardly. To ensure a minimum distance (stand-off) of the hollow charge 18 from an armor plate representing the target and to provide for a secure support of the hollow charge 18 and the explosive charge 17, the cap 12 has, at least internally, a specially downstepped shape in the forward direction. As a result, a deformation of the cap 12 may occur only in the frontal hollow hemispherical portion thereof, so that the rearward, form-stable, essentially cylindrical part of the cap 12 ensures at all times a minimum ignition distance for an optimal jet formation of the hollow charge 18.

The firing pin 20 according to the invention is arranged in the rearward detonator housing 14 and will be described in further detail in conjunction with FIGS. 2*a* and 2*b*.

The firing pin 20 according to the invention is composed preferably of a frontal firing pin part 20.1 and a rearward firing pin part 20.2 spaced from the part 20.1. The two firing pin parts 20.1 and 20.2 are held and guided mechanically in a bore 22 of a firing pin housing 21. Both firing pin parts 20.1 and 20.2 are preferably cylindrical and are spaced from one another by mechanical means 24, for example, by three balls 24 (only two balls are visible). The frontal firing pin part 20.1 has a firing pin tip 20.11 and a guiding region 20.12 adjoined by a socket region 20.13. A firing pin spring 23 positioned about the guide region 20.12 engages with one end a collar of the socket region 20.3 and is held at its other end by a shoulder 21.1 of the firing pin housing 21. The socket 20.13 has a frustoconical outer face 20.131 having a forwardly open cone angle β. The frustoconical outer face 20.131 supports preferably three circumferentially uniformly distributed balls 24 between the firing pin parts 20.1 and 20.2. The rearward firing pin part 20.2 has a greater outer diameter than the frontal firing pin part 20.1. The housing 21 has, in the region between the rearward firing pin part 20.2 and the frontal firing pin part 20.1, that is, in the region in which the balls 24 are arranged, a funnel-shaped (frustoconical) surface 21.2 which tapers forwardly at a cone angle a. The length of the surface 21.2 depends from the length of surface 20.131 of the frontal firing pin part 20.1. In the zone of the firing pin tip 20.11 the housing 21 has an inner stepped-down frontal terminal portion bordered by the inner shoulder 21.1 which, as noted before, counter supports the firing pin spring 23.

As the grenade projectile 10 impacts on the intended target, the rearward firing pin part 20.2 is pressed by inertia against the balls 24 which then, together with the rearward firing pin part 20.2 move in the direction of the frontal firing pin part 20.1 as shown in FIG. 2*b*. During this occurrence, the balls 24 run on the tapered (oblique) faces 21.2 of the housing 21 and the tapered (oblique) faces 20.131 of the socket 20.13 and press the socket part 20.13 by camming action forward, thus pushing the frontal firing pin part 20.1 against the force of the firing pin spring 23 outwardly of the housing 21. The balls 24, in cooperation with the oblique surfaces 21.2 and 20.131 produce an upstepped mechanical transmission ratio which affects the response time (that is, the delay of detonation from the moment of impact on the target). The frontal firing pin part 20.1 with its firing pin tip 20.11 is accelerated and penetrates in a known manner into a non-illustrated detonator charge whereby an ignition is effected. The formation of an undisturbed hollow charge beam and an optimal splintering effect occur in a known manner. Also, the explosive charge 17 is ignited which, in turn, accelerates the copper particles of the hollow charge 18. The copper particles form, in a known manner, a hollow charge "jet" which pierces the target and thus penetrates the same.

It has been found in practice that the selection of the angle $\alpha=\beta=90°$ provides for a transmission ratio of 1:1.58, whereby a secure and rapid detonation may be achieved. Stated differently, the time it takes for the rearward firing pin part 20.2 to travel a distance of 1 mm, the frontal firing pin part 20.1 is displaced 1.58 mm. It is, however, feasible to select the angles α and β in an angular range between 80° and 120°. It will be understood that an angle greater than 90° results in a greater transmission ratio whereas a flatter angle (less than 90°) provides for a smaller transmission ratio. The smaller transmission ratios have the advantage that a secure detonation is achieved but have the disadvantage of a larger reaction time, while the converse result is achieved for large transmission ratios.

The firing pin 20 according to the invention provides that mechanical bottom detonators may be used in faster and thus longer-range hollow charge grenade projectiles 10 than it has possible heretofore.

The above-described exemplary arrangement according to the invention may be modified, for example, in that the firing pin 20 may be divided into three or more parts in case an even more rapid reaction time is required. In such a case force-transmitting spacer balls 24 are positioned between each adjoining firing pin parts. Also, the divided firing pin 20 may be directly integrated into the projectile detonator without the provision of a firing needle housing 21. The firing needle parts 20.1 and 20.2 may be of polygonal cross-sectional shape; in such a case the firing pin housing 21 has no bore hole but an inner configuration which conforms to the peripheral outline of the firing pin parts 20.1 and 20.2.

It will be understood that the above description of the present invention is susceptible to various modifications, changes and adaptations, and the same are intended to be comprehended within the meaning and range of equivalents of the appended claims.

What is claimed is:

1. A firing pin assembly for mechanically igniting a warhead detonator of a projectile by being accelerated in a forward direction by inertia upon impact; comprising (a) a firing pin including
  (1) a rearward firing pin part; and
  (2) a frontal firing pin part arranged in series with said rearward firing pin part as viewed in said forward direction;

(b) a firing pin spring urging said firing pin in a direction opposite to said forward direction; and (c) a mechanical device positioned between said rearward firing pin part and said frontal firing pin part and including
  (1) means for spacing said rearward firing pin part from said frontal firing pin part; and
  (2) transmission means for transmitting a forward motion of said rearward firing pin part to said frontal firing pin part with a stepped up transmission ratio whereby a forward motion of said rearward firing pin part through a first distance results in a forward motion of said frontal firing pin part through a second distance against a force of said firing pin spring; said second distance being greater than said first distance.

2. The firing pin assembly as defined in claim 1, wherein said means for spacing include force-transmitting components contacting said rearward firing pin part and said frontal firing pin part; further comprising a firing pin housing defining a passage accommodating said rearward firing pin part, said frontal firing pin part and said components; further wherein said transmission means includes a frustoconical wall portion forming part of said firing pin housing and tapering in said forward direction; said components being in contact with said wall portion and moving therealong at an angle to said forward direction upon a forward motion of said rearward firing pin part.

3. The firing pin assembly as defined in claim 2, wherein said components are circumferentially distributed balls.

4. The firing pin assembly as defined in claim 2, wherein said rearward firing pin part has a diameter which is greater than a diameter of said frontal firing pin part.

5. The firing pin assembly as defined in claim 2, wherein said passage is a bore surrounded by said wall portion of said firing pin housing; and further wherein said rearward firing pin part and said frontal firing pin part are cylindrical.

6. The firing pin assembly as defined in claim 2, wherein said firing pin housing has a shoulder in said passage; said firing pin spring having opposite ends engaging said frontal firing pin part and said shoulder, respectively.

7. The firing pin assembly as defined in claim 2, further wherein said transmission means includes a frustoconical wall portion forming part of said forward firing pin part and widening in said forward direction; said components being in contact with said wall portion of said frontal firing pin part and moving therealong for displacing said frontal firing pin part in said forward direction by camming action between said components and said wall portion of said frontal firing pin part.

8. The firing pin assembly as defined in claim 7, wherein the cone angle of said frustoconical wall portions of said firing pin housing and said frontal firing pin part is between 80° and 120°.

9. The firing pin assembly as defined in claim 8, wherein the cone angle of said frustoconical wall portions of said firing pin housing and said frontal firing pin part is 90°.

* * * * *